United States Patent [19]

Harlow, Jr. et al.

[11] Patent Number: 4,714,192

[45] **Date of Patent: * Dec. 22, 1987**

[54] SLIDABLE TRAY INSERT FOR MAILBOXES

[75] Inventors: Albert L. Harlow, Jr., Norwalk; Arthur M. Felske, Westport, both of Conn.

[73] Assignee: EZ Mail Corporation, Bridgeport, Conn.

[ * ] Notice: The portion of the term of this patent subsequent to Jul. 15, 2003 has been disclaimed.

[21] Appl. No.: 883,928

[22] Filed: Jul. 10, 1986

Related U.S. Application Data

[63] Continuation of Ser. No. 702,060, Feb. 15, 1985, Pat. No. 4,600,143.

[51] Int. Cl.[4] ..... B65P 91/00

[52] U.S. Cl. ..... 232/17; 232/33; 211/126

[58] Field of Search ..... 232/17, 1, 30–33, 232/45, 24, 27, 28, 29, 38; 109/19; 312/126; 206/557; 312/330 R, 330 SM, 334, 338; 211/126, 131

[56] References Cited

U.S. PATENT DOCUMENTS

| | | | |
|---|---|---|---|
| 838,194 | 12/1906 | Larsh | 232/17 |
| 908,543 | 1/1909 | Brown | 232/17 |
| 1,050,252 | 1/1913 | Thorson | 232/17 |
| 1,220,251 | 3/1917 | Martin | 232/17 |
| 1,471,899 | 10/1923 | Koenig | 232/17 |
| 1,654,692 | 1/1928 | Marois | 232/17 |
| 2,760,721 | 8/1956 | Roberts | 232/17 |
| 2,781,964 | 2/1957 | Ledgerwood | 232/17 |
| 2,868,444 | 1/1959 | Whittier | 232/17 |
| 2,904,381 | 9/1959 | Prince | 312/126 |
| 3,606,140 | 9/1971 | Shannahan | 232/17 |
| 4,121,758 | 10/1978 | Bonner | 232/17 |
| 4,160,520 | 7/1979 | Cluthé | 232/17 |
| 4,362,267 | 12/1982 | Donaldson | 232/17 |
| 4,372,480 | 2/1983 | Mitchell et al. | 232/17 |
| 4,600,143 | 7/1986 | Harlow et al. | 232/17 |

*Primary Examiner*—Gene Mancene
*Assistant Examiner*—John Weiss
*Attorney, Agent, or Firm*—K. Bradford Adolphson

[57] ABSTRACT

A conventional rural mailbox has a slidable tray insert therein molded from a plastic material exhibiting natural flexural characteristics with a generally rectangular configuration defined by a bottom wall with a pair of side walls and an end wall extending upwardly therefrom. The bottom wall has a handle inclined upwardly therefrom and spaced from the side walls and end wall. The handle is operatively connected to the bottom wall by a flexible live hinge permitting relative movement therebetween. Each of the side walls include a flexible finger element thereon for centrally locating the tray insert within the mailbox and limiting relative sliding movement therebetween. The end wall has a rearwardly inclined resilient semicircular member thereon for moving the tray insert partially out of the mailbox to expose the handle when the mailbox is opened and for maintaining the tray insert in a level position when it is fully extended from the mailbox.

18 Claims, 7 Drawing Figures

SLIDABLE TRAY INSERT FOR MAILBOXES

This is a continuation of co-pending application Ser. No. 702,060 filed on Feb. 15, 1985, now U.S. Pat. No. 4,600,143.

BACKGROUND OF THE INVENTION

The present invention relates generally to a mailbox used on rural mail delivery routes, and more particularly to a rural type mailbox having a slidable tray insert therein utilized to assist the gathering of mail from the mailbox.

Conventional U.S. Postal Service approved mailboxes with a pivotally attached door and a mechanical latching device have been used for many years on rural mail delivery routes. In delivering the mail, the postal service employee normally opens the door pivoted of the mailbox and deposits the mail therein. The owner of the mailbox must then open the door and search the entire enclosure of the mailbox for the deposited mail normally by visual inspection thereof and subsequent insertion of the hand and arm into the confines of the enclosure to retrieve the mail.

After dark, a visual inspection is nearly impossible and the owner is required to perform the search utilizing solely the tactile sense in an attempt to locate and retrieve the mail. Additionally, in attempting to retrieve the mail, the owner oftentimes is within his motor vehicle and is required to stretch uncomfortably or even alight from the motor vehicle to reach the mail within the mailbox. Such a situation is quite undesirable, especially in inclement weather.

The present invention is designed to overcome the above-noted limitations that are attendant upon the use of the conventional rural type mailbox, and toward this end, it contemplates the provision of a novel tray insert slidably seated within the enclosure of the mailbox thereby providing easy accessibility to the deposited mail.

It is an object of the invention to provide a tray insert which can be provided as an original accessory for new mailboxes or easily inserted in existing mailbox installations.

It is also an object to provide such a device which will meet the standards and specifications of the U.S. Postal Service.

Still another object is to provide such a device to eliminate searching and stretching for deposited mail located within the enclosure of the mailbox.

A further object is to provide such a device which may be readily and economically fabricated and will enjoy a long life in operation.

SUMMARY OF THE INVENTION

It has now been found that the foregoing and related objects can be readily attained in a conventional U.S. Postal Service approved rural mailbox having a slidable tray insert therein. The rural mailbox has a generally rectangular bottom panel, a back panel and a U-shaped roof portion defining an enclosure with an entrance opening at one end thereof. A door member is pivotally mounted adjacent the entrance opening for movement between an open position permitting access to the enclosure through the entrance opening and a closed position covering the entrance opening.

The tray insert is slidably seated within the enclosure of the mailbox for movement through the entrance opening between a retracted position completely within the enclosure and a fully protracted position partially without the enclosure. The tray insert includes a generally rectangular bottom wall, a pair of side walls extending upwardly from the bottom wall, and an end wall extending upwardly from the bottom wall and transversely between the side walls. Normally inclined upwardly from the bottom wall opposite the end wall is a handle which is spaced from the side walls. The handle is associated with a resilient "living" hinge provided by an area of reduced wall thickness at a juncture between the handle and the bottom wall thereby permitting pivoting movement of the handle from its upwardly inclined position.

Cantilevered from each of the side walls adjacent the upper sides thereof are resilient finger elements which extending outwardly and forwardly at an acute angle thereto adjacent the end wall. The finger elements are biased against the roof portion and cooperate to centrally locate the tray within the enclosure. Additionally, the finger elements are operationally disposed to engage a rolled-over edge portion of the mailbox when the tray is in its fully protracted position.

Extending upwardly from the end wall is a rearwardly inclined semicircular shaped member for engaging the back panel of the mailbox when the door member thereof is in its closed position and for moving the tray insert from its retracted position through the entrance opening to a partially protracted position when the door member is moved from its closed position to its open position. Conveniently, the semicircular member also maintains the tray insert in a level position when the tray insert is in its protracted position.

Desirably, the side walls have abutment surfaces at the forward ends thereof for engaging the door of the mailbox when the door is in its closed position. The side walls also have enlarged lug portions thereon adjacent the abutment surfaces.

Our invention will be more fully understood when reference is made to the following detailed description taken in conjunction with the accompanying drawings.

DETAILED DESCRIPTION OF THE PREFERRED EMBODIMENT

Figure 1:
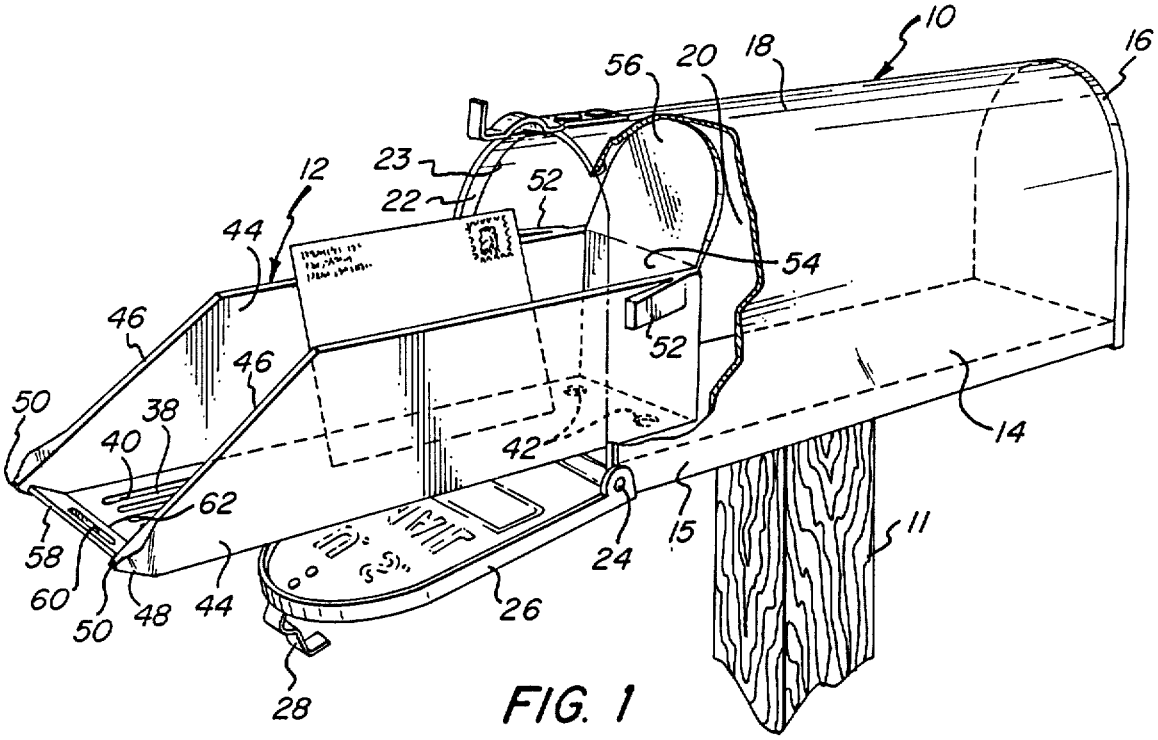
FIG. 1 is a perspective view of a mailbox and a tray insert embodying the present invention with a portion of the mailbox partially broken away to show internal structure.

Referring first to FIG. 1, therein is illustrated a conventional rural type mailbox generally indicated by numeral 10 mounted on a vertical post 11 secured in the ground, and a tray insert generally designated by the numeral 12 used with the mailbox, according to the present invention. The tray insert 12 is in the form of a drawer slidably seated within the mailbox 10.

Figure 2:
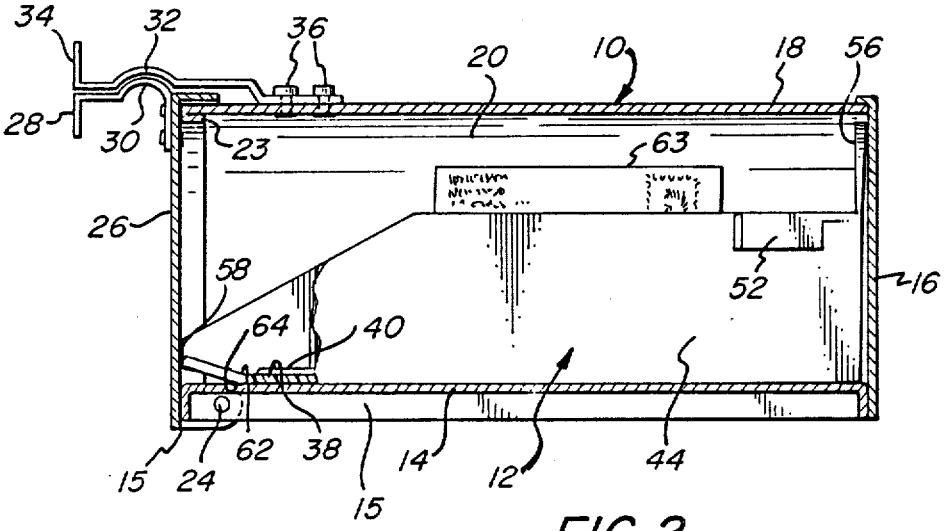
FIG. 2 is a side elevational view of the mailbox with its door in the closed position and with portions broken away to show the internally seated tray insert which also has a portion broken away for clarity of illustration.

The mailbox 10 has a generally rectangular bottom panel 14 having downwardly projecting flange portions 15 around the periphery thereof, an arcuately shaped back panel 16 extending upwardly from one end of the bottom panel 14, and an arcuately curved inverted U-shaped roof portion 18 spanning the bottom panel 14 and defining an enclosure 20 for receiving envelopes, parcel post packages and the like through an entrance opening 22 located at the anterior end thereof. As best seen in FIG. 2, the roof portion 18 has a rolled abutment edge 23 at the entrance opening 22.

Pivotally attached by means of pivot pins 24 to the flange portions 15 and the lower end of the roof portion 18 adjacent the entrance opening 22 is a door or closure 26. The door 26 includes a finger hold 28 cantilevered therefrom at the distal end thereof to enable manipulation of the door 26 by a user between an open position (FIG. 1) permitting access to the enclosure 20 through the entrance opening 22 and a closed position (FIG. 2) covering the entrance opening 22. The finger hold 28 has a convexly raised portion 30 thereon for mating engagement with a concave recess 32 formed by a resilient latch 34. The latch 34 is cantilevered from the roof portion 18 by means of a pair of fastening elements 36 and is positioned in the arcuate path of movement of the door 26 and its finger hold 28. This arrangement enables the latch 34 to deflect upwardly when it is engaged by the finger hold 28 and provides a snug fit therebetween when the door 28 is in its closed position (FIG. 2).

The mailbox 10 and its components are preferably stamped from corrosion-resistant sheet metal alloy material such as a galvanized steel or aluminum. The components are assembled by conventional welding, riveting or other metal forming techniques. To be in conformance with U.S. Postal Service standards, the mailbox 10 must accept certain parcel sizes and the opening 22 must have a certain minimum unrestricted area.

Figure 4:
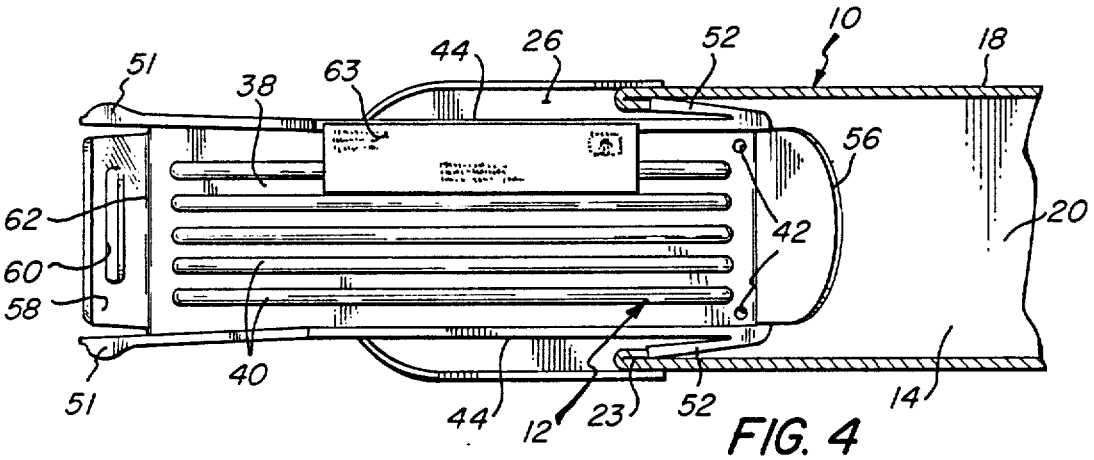
FIG. 4 is a fragmentary top elevational view of the mailbox with portions broken away to show the tray insert in its protracted or extended position.
Figure 5:
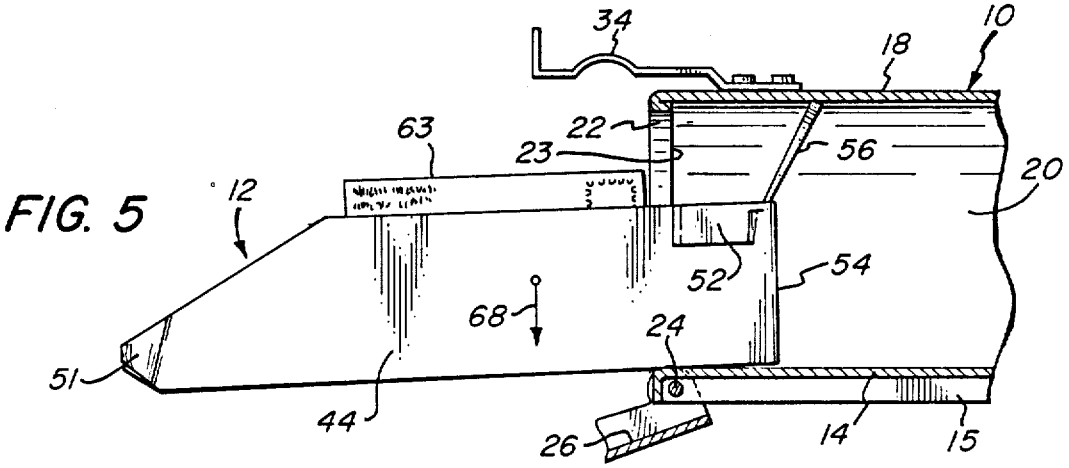
FIG. 5 is a fragmentary side elevational view of the mailbox and the tray insert in the position of FIG. 4 with portions of the mailbox broken away to show internal structure.

The tray insert 12 of the present invention is dimensionally sized to slide within the enclosure 20 and through the entrance opening 22 defined by the mailbox 10 between a retracted position completely within the enclosure 20 as illustrated in FIG. 2 and a protracted or extended position as shown in FIGS. 4 and 5. The tray insert 12 includes a bottom wall 38 having a generally rectangular configuration which tapers outwardly at the forward end thereof. The bottom wall is provided with a series of parallel ribs 40 thereon to prevent mail from adhering to the bottom wall as a result of rain or snow entering through the opening 22 and with a pair of water drainage apertures 42 therein for preventing water buildup thereon. Extending upwardly from the bottom wall 38 are a pair of generally parallel side walls 44 having a downwardly and forwardly inclined surfaces 46 joined to upwardly and forwardly inclined surfaces 48 by abutment surfaces 50. Adjacent each of the abutment surfaces 50 are enlarged outwardly extending beveled lugs 51 on the side walls 44. The side walls 44 each have a resilient finger element or side clip 52 projecting outwardly and forwardly at an acute angle from adjacent the posterior end of the tray insert 12. As shown in FIGS. 4 and 5, the finger elements 52 are biased against the roof portion 18 of the mailbox 10 to centrally locate the tray insert 12 within the enclosure 20 and to engage the rolled abutment edge 23 of the mailbox 10, thereby limiting forward movement of the tray insert 12 in its protracted position. The finger elements 52 have a relatively large thickness at their terminal ends to prevent them from interlocking with the rolled edge 23.

Figure 7:
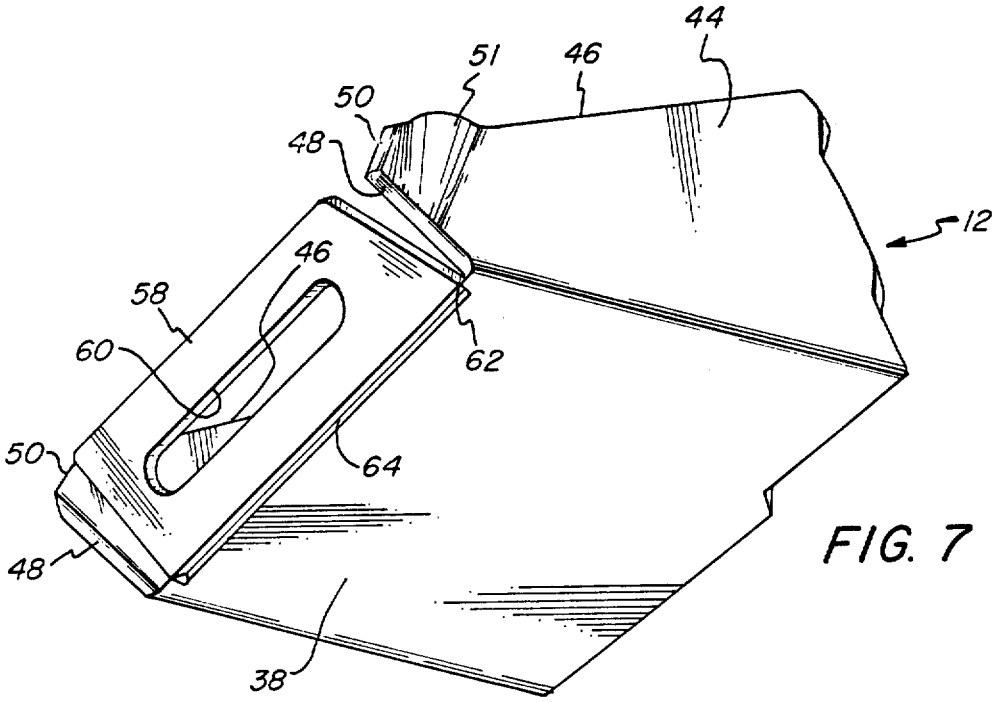
FIG. 7 is an enlarged fragmentary perspective view of the tray insert illustrating the handle detail.

Projecting upwardly from the bottom wall 38 and extending transversely between the side walls 44 is an end wall 54 with a resilient upwardly extending and rearwardly inclined semicircular shaped member 56 thereon. Located at the other end of the bottom wall 38 adjacent the abutment surfaces 50 of the side wall 44 is a normally upwardly inclined handle 58 with a centrally located finger opening 60. The handle 58 is spaced from the side walls 44 and is operatively connected to the bottom wall 38 by means of a flexible "live" hinge 62 by which the handle 58 can be moved relative to the bottom wall 38. As seen in FIG. 7, the live hinge 62 is provided by an elongated rectangular groove 64 formed at the juncture of the handle 58 and the bottom wall 38 on the underside thereof and defining an area of reduced wall thickness having a natural resiliency or flexural characteristic creating a resilient memory therein.

The use and operation of the present invention are shown in FIGS. 2-5. The tray insert 12 is initially located in its completely retracted position within the enclosure 20 of the mailbox 10 with the door 26 in its closed and latched position. It should be appreciated that the overall length of the tray insert 12 is slightly greater than the overall length of the enclosure 20 so that the abutment surfaces 50 engage the door 26 and force the resilient semicircular shaped member 56 against the back panel 16. The member 56 will deflect forwardly thereby reducing the overall length of the tray insert 12 enabling it to fit snuggly within the enclosure 20.

As can be seen in FIG. 2, a piece of mail 63 has been deposited in the mailbox 10 on the tray insert 12. To retrieve the mail 63 from the enclosure 20, the door 26 can be pivoted to its open position shown in FIG. 3. The tray insert 12, no longer restrained by the door 26, moves forwardly, as indicated by arrow 66, through the opening 22 under the influence of the natural resilient memory of the semicircular shaped member 56 acting against the back panel 16. The enlarged lugs 51 on the side walls 44 discourage the abutment surfaces 50 of the tray insert 12 from becoming lodged against the rolled abutment edge 23 of the mailbox 10 thereby enabling the unobstructed forward movement of the tray insert 12. In the partially protracted position of FIG. 3, the handle 58 is disposed outwardly of the enclosure 20 in position to facilitate grasping contact by the user.

Figure 3:
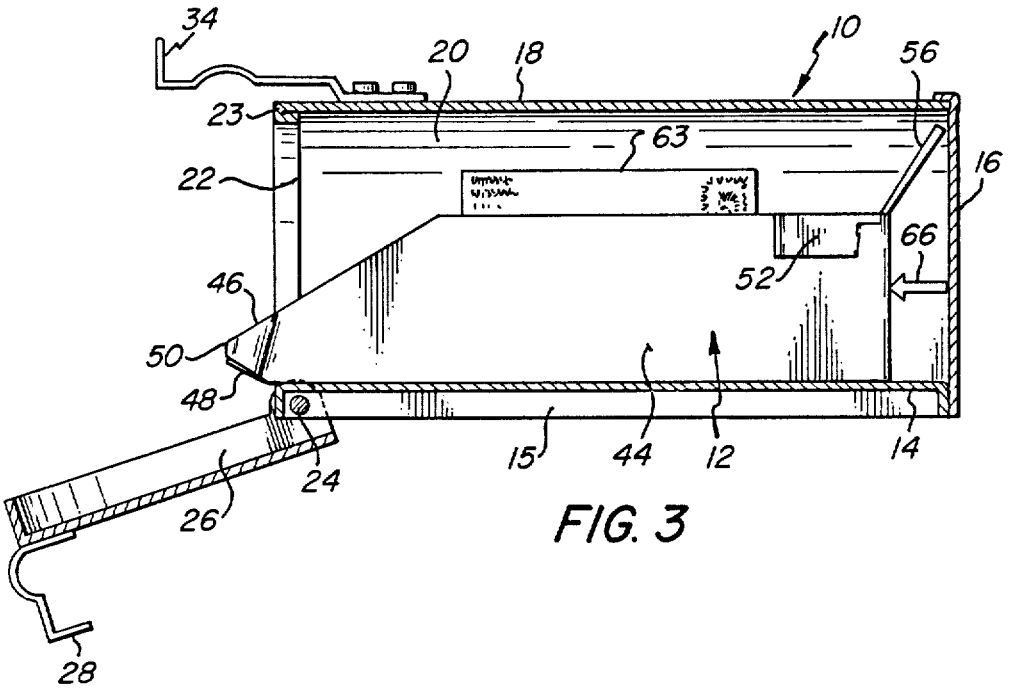
FIG. 3 is a view similar to the view of FIG. 2 but showing the door of the mailbox in its open position, and the tray insert biased outwardly under the influence of its resilient semicircular member through the entrance opening of the mailbox.

From the partially protracted position of FIG. 3, the user can manipulate the tray insert 12 forwardly by utilizing the handle 58 and pulling the tray insert 12 through the opening 22 until the resilient finger elements 52 abut opposite sides of the rolled abutment edge 23 of the mailbox 10 (FIGS. 4 and 5). In this fully protracted or extended position, the center of gravity 68 (see FIG. 5) of the tray insert 12 is disposed outwardly of the enclosure 20 and causes the tray insert 12 to pivot about the front edge of bottom panel 14. However, such pivoting movement is limited by the operative engagement of the semicircular member 56 with the roof portion 18 thereby maintaining the tray insert 12 in a level position and providing easy accessibility to the mail 63. The member 56 prevents the tray insert 12 from falling forward and dumping its contents 63 on the ground. The inclined handle also inhibits forward movement of the mail 63 and prevents the mail from sliding onto the ground when the tray insert 12 is in its protracted position. To reinsert the tray insert 12 within the enclosure 20, the aforesaid procedure is simply reversed.

As can be readily appreciated from FIG. 3, the portion of the tray insert 12 which projects from the mailbox 10 when the postal service employee opens the door 26 to deposit the mail 63 is relatively unobtrusive. Accordingly, normal mail delivery can take place by simply tossing the mail onto the partially protracted tray insert 12 and closing the door 26.

Figure 6:
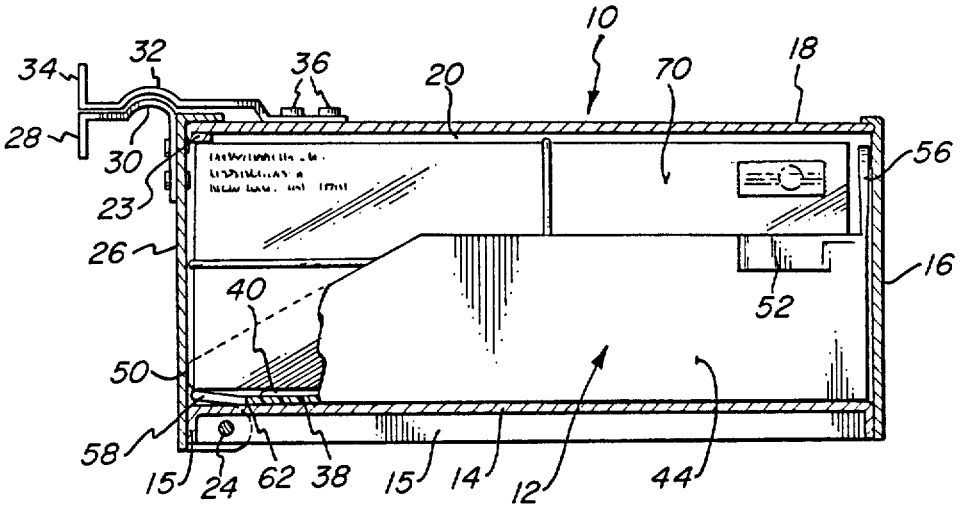
FIG. 6 is a side elevational view similar to FIG. 2 with a large parcel post package biasing the handle on the tray insert to its noninclined position.

To meet the standards and specifications of the U.S. Postal Service concerning minimum package size and minimum unrestricted opening area, the tray insert 12 includes the flexible live hinge 62 which permits the handle 58 to fold into a noninclined position flat against the bottom panel 14. As shown in FIG. 6, a large parcel post package 70 is shown inserted in the mailbox 10 on the tray insert 12. In order to provide adequate room for such a large package, the handle 58 is biased downwardly by the package 70 toward the bottom panel 14 pivoting at the live hinge 62. When the package 70 is removed, the resilient memory of the live hinge 62 will return the handle to its normal inclined position.

It should be appreciated that the tray insert 12 of the present invention can be easily installed in or removed from the mailbox 10 by simply manipulating the resilient finger elements 52 past the rolled edge 23 as they pass through the opening 22.

The tray insert 12 is preferably a one-piece unit integrally molded from a plastic resin such as high density polyethylene or a polypropylene and homopolymer mixture but it should be apparent to those skilled in the art that it may be manufactured from other suitable materials which exhibit weather resistant qualities and the desired resiliency to permit the flexing movement of the finger elements 52, semicircular shaped member 56 and the handle 58. The tray insert of the present invention can be made in a variety of sizes to conform to the various standard U.S. rural mailbox sizes.

Thus, it can be seen from the foregoing specification and the attached drawings that the tray insert of the present invention provides an effective means for facilitating deposit and removal of the mail in the associated mailbox.

The preferred embodiment described above admirably achieves the objects of the invention; however, it will be appreciated that departure can be made by those skilled in the art without departing from the spirit and scope of the invention which is limited only by the following claims.

Having thus described the invention, what is claimed is:

1. A slidable tray insert for use in combination with a rural mailbox having a bottom panel, a back panel and a U-shaped roof portion defining an enclosure with an entrance opening at one end thereof, and a door member pivotally mounted adjacent said entrance opening for movement between an open position permitting access to the enclosure through the entrance opening and a closed position covering the entrance opening, comprising: a generally rectangular bottom wall, a pair of side walls extending upwardly from said bottom wall, an end wall extending upwardly from said bottom wall and transversely between said side walls, and a handle disposed on said bottom wall spaced from said side walls, said handle being connected to the bottom wall by hinge means permitting pivoting movement of said handle between an upwardly inclined position and a position flush with said bottom wall.

2. The slidable tray insert in accordance with claim 1 wherein said handle has a centrally located finger engageable aperture therein.

3. The slidable tray insert in accordance with claim 1 wherein said hinge means is a resilient hinge means provided by an area of reduced wall thickness at a juncture between said handle and said bottom wall.

4. The slidable tray insert in accordance with claim 1 further including a flexible finger element on each of said side walls extending outwardly and forwardly at an acute angle thereto.

5. The slidable tray insert in accordance with claim 4 further including means for engaging the back panel of the mailbox when the door member thereof is in its closed position, for moving said tray insert away from the back panel and through the entrance opening when the door member is in its open position.

6. The slidable tray insert in accordance with claim 4 further including means for engaging the roof portion of the mailbox and maintaining said tray insert in a substantially level position relative to the mailbox when said tray insert is slid to a fully protracted position with its center of gravity outside the enclosure of the mailbox.

7. The slidable tray insert in accordance with claim 1 further including means for engaging the back panel of the mailbox when the door member thereof is in its closed position and for moving said tray insert away from the back panel and through the entrance opening when the door member is in its open position.

8. The slidable tray insert in accordance with claim 7 further including means for engaging the roof portion of the mailbox and maintaining said tray insert in a substantially level position relative to the mailbox when said tray insert is slid to a fully protracted position with its center of gravity outside the enclosure of the mailbox.

9. The slidable tray insert in accordance with claim 1 further including means for engaging the roof portion of the mailbox and maintaining said tray insert in a substantially level position relative to the mailbox when said tray insert is slid to a fully protracted position with its center of gravity outside the enclosure of the mailbox.

10. A slidable tray insert for use in combination with a rural mailbox having a bottom panel, a back panel, and a U-shaped roof portion defining an enclosure with an entrance opening at one end thereof, and a door member pivotally mounted adjacent said entrance opening for movement between an open position permitting access to the enclosure through the entrance opening and a closed position covering the entrance opening, comprising: a generally rectangular bottom wall, a pair of side walls extending upwardly from said bottom wall, an end wall extending upwardly from said bottom wall transversely between said side walls, and means on said end wall for engaging the roof portion of the mailbox and maintaining said tray insert in a substantially level position relative to the mailbox when said tray insert is slid to a fully protracted position with its center of gravity outside the enclosure of the mailbox, said means is a semicircular shaped member extending upwardly from said end wall, said semicircular shaped member is rearwardly inclined for engaging the back panel of the mailbox when the door member thereof is in its closed position and for moving said tray insert away from the back panel and through the entrance opening when the door member is in its open position.

11. A slidable tray insert for use in combination with a rural mailbox having a bottom panel, a back panel and a U-shaped roof portion defining an enclosure with an entrance opening at one end thereof, and a door member pivotally mounted adjacent said entrance opening for movement between an open position permitting access to the enclosure through the entrance opening and a closed position covering the entrance opening, comprising: a generally rectangular bottom wall, a pair of side walls extending upwardly from said bottom wall, an end wall extending upwardly from said bottom wall transversely between said side walls, means on said end wall for engaging the roof portion of the mailbox and maintaining said tray insert in a substantially level position relative to the mailbox when said tray insert is slid to a fully protracted position with its center of gravity outside the enclosure of the mailbox, and a flexible finger element on each of said side walls extending outwardly and forwardly at an acute angle thereto form adjacent said end wall.

12. The slidably tray insert in accordance with claim 11 wherein said flexible finger elements are cantilevered from said side walls adjacent upper sides thereof.

13. In combination,

A. a rural mailbox having a generally rectangular bottom panel, a back panel and a U-shaped roof portion defining an enclosure with an entrance opening at one end thereof and a door member pivotally mounted adjacent said entrance opening for movement between an open position permitting access to said enclosure through said entrance opening and a closed position covering said entrance opening; and B. a tray insert slidably seated within said enclosure of sasid mailbox for movement through said entrance opening between a retracted position completely within said enclosure and a protracted position partially within said enclosure, comprising:

i. a generally rectangular bottom wall;

ii. a pair of side walls extending upwardly from said bottom wall;

iii. an end wall extending upwardly from said bottom wall and transversely between said side walls; and iv. means extending upwardly from said end wall for maintaining said tray insert in a substantially level position by contacting said U-shaped roof portion when said tray insert is in a protracted position with its center of gravity outside the enclosure of the mailbox.

14. The combination in accordance with claim 13 further including a handle disposed on said bottom wall opposite said end wall and spaced from said side walls, said handle being connected to the bottom wall by hinge means for permitting movement of said handle between an upwardly inclined position and a position flush with said bottom wall.

15. The combination in accordance with claim 14 wherein said hinge means is provided by an area of reduced wall thickness at a juncture between said handle and said bottom wall.

16. In combination,

A. a rural mailbox having a generally rectangular bottom panel, a back panel and a U-shaped roof portion defining an enclosure with an entrance opening at one end thereof and a door member pivotally mounted adjacent said entrance opening for movement between an open position permitting access to said enclosure through said entrance opening and a closed position covering said entrance opening, said roof portion having a rolled over edge defining said entrance opening; and B. a tray insert slidably seated within said enclosure of said mailbox for movement through said entrance opening between a retracted position completely within said enclosure and a protracted position partially within said enclosure, comprising:

i. a generally rectangular bottom wall;

ii. a pair of side walls extending upwardly from said bottom wall, each of said side walls includes an abutment surface at the forward end thereof;

iii. an end wall extending upwardly from said bottom wall and transversely between said side walls; and iv. means on said side walls for preventing the forward ends of said side walls from interlocking with said rolled over edge of said roof portion of said mailbox, wherein said means on said side walls for preventing interlocking comprise enlarged lug portions on said side walls adjacent said abutment surfaces.

17. The combination in accordance with claim 16 wherein each of said side walls includes a downwardly and forwardly inclined surface joined to an upwardly and forwardly inclined surface at its abutment surface.

18. In combination,

A. a rural mailbox having a generally rectangular bottom panel, a back panel and a U-shaped roof portion defining an enclosure with an entrance opening at one end thereof and a door member pivotally mounted adjacent said entrance opening for movement between an open position permmitting access to said enclosure through said entrance opening and a closed position covering said entrance opening, said roof portion having a rolled over edge defining said entrance opening; and B. a tray insert slidably seated within said enclosure of said mailbox for movement through said entrance opening between a retracted position completely within said enclosure and a fully protracted position partially within said enclosure, comprising:

i. a generally rectangular bottom wall;

ii. A pair of side walls extending upwardly from said bottom wall;

iii. an end wall extending upwardly from bottom wall and transversely between said side walls; and iv. a flexible finger elements on each of said side walls cantilevered outwardly and forwardly at an acute angle to its associated side wall adjacent said end wall, said resilient finger elements are operationally disposed to engage said rolled over edge defining said entrance opening of said mailbox when said tray is to its fully protracted position, said flexible finger elemens have relatively large thicknesses at their terminal ends to prevent said finger elements from interlocking with said rolled over edge of said roof portion of said mailbox.

* * * * *

UNITED STATES PATENT AND TRADEMARK OFFICE

CERTIFICATE OF CORRECTION

PATENT NO. : 4,714,192

DATED : December 22, 1987

INVENTOR(S) : Albert L. Harlow, Jr. et al

It is certified that error appears in the above-identified patent and that said Letters Patent is hereby corrected as shown below:

Title page:

Under "References Cited" insert:
--1,586,666 6/1926 Folts.....206/45.18--,
--2,507,785 5/1950 Hartman.....232/19--- ;

Column 7, line 43, for "sasid" substitute--said--,
Column 8, line 52, for "A" substitute --a--;
Column 8, line 54, after "from", insert --said--,
Column 8, line 57, for "elements", substitute --element--,
Column 8, line 63, for "to" substitute --in--,
Column 8, line 64, for "elemens", substitute -- elements--;

Signed and Sealed this

Fourteenth Day of June, 1988

*Attest:*

DONALD J. QUIGG

*Attesting Officer*

*Commissioner of Patents and Trademarks*